US005515620A

United States Patent [19]

Butler

[11] Patent Number: 5,515,620

[45] Date of Patent: May 14, 1996

[54] METHOD AND APPARATUS OF ROTATABLE DRUM DRYER WITH FLIGHTS RELEASABLY SECURED IN DIFFERENT ORIENTATIONS

[75] Inventor: Theodore G. Butler, Orlando, Fla.

[73] Assignee: Gencor Industries, Inc., Orlando, Fla.

[21] Appl. No.: 337,116

[22] Filed: Nov. 10, 1994

[51] Int. Cl.[6] ..... D06F 58/00; B28C 5/46

[52] U.S. Cl. ..... 34/137; 34/386; 432/118; 366/25; 366/57

[58] Field of Search ..... 34/130, 135, 137, 34/599, 602, 386; 110/224, 226; 432/110, 118; 366/25, 57, 58, 59

[56] References Cited

U.S. PATENT DOCUMENTS

| | | | |
|---|---|---|---|
| 3,641,683 | 2/1972 | Preeman | 432/118 X |
| 4,189,300 | 2/1980 | Butler . | |
| 4,293,228 | 10/1981 | Swisher, Jr. et al. | 366/25 |
| 4,307,520 | 12/1981 | Lutz | 34/135 X |
| 4,995,809 | 2/1991 | Filges et al. | 432/118 |
| 5,083,382 | 1/1992 | Brashears . | |
| 5,380,082 | 1/1995 | Milstead | 366/25 |
| 5,380,084 | 1/1995 | Milstead | 366/25 |

FOREIGN PATENT DOCUMENTS

| | | | |
|---|---|---|---|
| 1695098 | 11/1991 | U.S.S.R. | 432/110 |

*Primary Examiner*—Hoang Nguyen
*Attorney, Agent, or Firm*—Nixon & Vanderhye

[57] ABSTRACT

An apparatus and method for operating a rotatable drying drum are disclosed herein. The drying drum has a burner for generating hot gases of combustion for flow through the drum to dry aggregate. The drum includes identical drying flights each having a generally U-shaped body having side walls extending from opposite edges of a base and terminating in first and second edges having different configurations and consequent different veiling effects in the dryer by securing the flights in one of a plurality of orientations within the drum. By reorienting the identical flights within the drying zone of the rotary drum dryer, the veiling patterns of the aggregate across the drum may be altered, hence adjusting the exhaust temperature.

11 Claims, 4 Drawing Sheets

METHOD AND APPARATUS OF ROTATABLE DRUM DRYER WITH FLIGHTS RELEASABLY SECURED IN DIFFERENT ORIENTATIONS

TECHNICAL FIELD

The present invention relates to rotary drum dryers for drying particulate matter, and particularly relates to rotary drum dryers having flights for creating a veiling pattern across the interior of the drum and which can be releasably secured in different orientations within the drum to adjust the exhaust temperature of the hot gases in the drum used for drying the particulate matter.

BACKGROUND

Rotary drum dryers have been used in many environments for drying particulate materials. For example, in the asphalt industry, inclined rotary drum dryers are used for drying virgin aggregate before it is combined with recyclable asphalt or liquid asphalt, or both, to form an asphaltic pavement mix. In a typical drum dryer, there is provided a generally elongated cylindrical drum having a burner for flowing hot gases of combustion along the drum. Virgin aggregate is disposed in the drum for flow through the drum from one end to the other, either in a counterflow or parallel flow arrangement with the direction of flow of the hot gases of combustion. In a counterflow rotary drum dryer which is also used for mixing the dried aggregate with recycle asphaltic material or liquid asphalt, or both, the burner is typically disposed intermediate the ends of the inclined drum and aggregate is input to the upper end of the drum for flow in a drying zone toward the burner. Once past the burner, the dried aggregate is combined with the asphaltic materials in a mixing zone.

In drums of this type, flights are circumferentially spaced one from the other about and at various axial positions along the walls of the drum in the drying zone. Spiral inlet flights are provided to direct the virgin aggregate toward the drying flights in the drying zone. Once the aggregate has been dried, the aggregate is carried by combustion flights which preclude the aggregate from veiling in the flame of the burner. The aggregate then passes to the mixing zone.

The drying flights conventionally provide a veiling effect across the drum cross-section. That is, the flights will pick up moist aggregate adjacent the bottom of the drum and, as the drum rotates, distribute that aggregate in a veiling pattern across the drum. The aggregate veil efficiently absorbs heat from the hot gases of combustion flowing axially through the drum. It will be appreciated that there are significant differences in the drying characteristics of various aggregates. For example, it is not uncommon for aggregate of a certain size to veil only partially across the drum cross-section, leaving an opening in the veil through which hot gases of combustion may flow. That is, the hot gases will typically flow toward an area of least resistance and, hence, the exhaust temperature from the drum will rise if there is a significant opening through the veil. Various configurations of flights have been used to attempt to control the veiling action and, hence, adjust the exhaust gas stack temperature. For example, in U.S. Pat. No. 5,083,382, of common assignee herewith, adjustable flights with radially inwardly projecting dams are disclosed whereby the positions of the flights can be adjusted to alter the veiling effect. Those flights are adjusted by pivoting into selected angular positions dependent upon the type of aggregates used or other production parameters. The present invention affords an improvement upon such angularly adjustable flights by employing a plurality of identical flights which can be secured in different orientations to adjust the veiling pattern across the drum and, hence, adjust the exhaust temperature.

It will also be recognized that flights of different configurations have previously been used in drying drums to effect different veiling patterns. Hence, a supply of different types of flights was typically necessary for use with each drum, depending upon the desired veiling effect which, in turn, was dependent upon the type and gradation of the aggregate and other parameters of the drying process.

DISCLOSURE OF THE INVENTION

According to the present invention, there is provided a plurality of identical flights for use in the drying zone of a rotary drum dryer or mixer and which flights can be releasably secured in various orientations within the drum to alter the veiling pattern and, hence, adjust the stack exhaust temperature. To accomplish this, there is provided a plurality of flights, each of which comprises a flight body having a base and side walls upstanding from the base and inclining away from one another. The edges of the side walls distal from the base are formed differently. One edge is provided with a sawtooth pattern, while the other edge is preferably generally straight. The different edges provide different veiling characteristics for the aggregate as the drum rotates and the aggregate falls from one edge to form the veil. Partitions are also provided at the opposite ends and intermediate each flight to control the axial flow of aggregate along the drum. Flight mounting brackets are disposed at circumferentially and axially spaced positions about the drum for securing the flights for projection inwardly from the interior wall of the drum and in axially spaced sets of flights. These brackets are preferably inverted, generally V-shaped brackets welded at their distal ends to the interior wall of the drum. Each leg of the bracket is provided with an opening for receiving a fastener, e.g., a bolt, by which the flights may be secured to the brackets. Two or more brackets are preferably used for releasably securing each flight to the drum wall. The side walls and base of each flight are provided with openings for receiving bolts which pass through such openings and the openings of the brackets whereby the flights can be bolted to the brackets. By locating the openings in the flights in both of the side walls and in the base, the flights can be oriented in any one of five discrete positions.

In a first orientation, each flight may be secured, e.g., by bolting to the brackets, with the first side wall having its sawtooth edge away from the drum wall and the second or opposite side wall lying generally parallel to and in close juxtaposition to the drum wall. In this first is orientation, the flights are bolted through the openings in the base to the brackets. In a second orientation, the flights are reversed from the first orientation. That is, the second side wall with the generally straight edge is away from the drum surface and the first side wall with the sawtooth edge lies generally parallel to and in close juxtaposition to the drum wall, again with the flights being bolted through the base to the brackets. By affording a choice of orientations of the identical flight with either the sawtooth edge or the generally straight edge away from the wall, the veiling characteristics may be altered. The sawtooth edge, of course, provides for an earlier cascade of the aggregate across the rotating drum than the straight edge. Consequently, if the exhaust temperature is too low, it may be increased by securing the flights to the drum wall with the sawtooth edges away from the drum wall, affording a larger opening through the veil for the passage of the hot gases of combustion. Conversely, if the exhaust temperature is too high, a greater veiling effect is warranted and therefore the flights are secured with their generally straight edges away from the wall whereby the aggregate veiling effect is extended further across the cross-section of the drum in the direction of rotation, hence affording greater heat exchange with the hot gases of combustion and cooling the exhaust gas temperature.

By securing one or the other of the side walls of the identical flights to the brackets in third or fourth orientations, a greater veiling effect can be accomplished as compared with securing the bases of the flights to the brackets as in the previously described first and second orientations. In the third and fourth orientations, the flights are inclined further in the direction of rotation of the drum and, hence, hold more material than when in the first or second orientations. The veiling effect of the flights in the third and fourth orientations is again dependent upon which of the two edges of the side walls is away from the drum wall. If 5 the second side wall with the generally straight edge is secured to the brackets, leaving the first side wall with the sawtooth edge away from the drum wall in a third orientation of the flights, the cascade of aggregate starts later in the direction of drum rotation. By securing the first side wall with the sawtooth edge to the brackets in a fourth orientation of flights, an even later veiling effect is created with a larger amount of the aggregate, hence reducing stack exhaust temperatures.

In a fifth orientation of the identical flights relative to the drum, the flights can be inverted such that the distal edges of the side walls lie in close juxtaposition with or engage the side walls of the drum. The flights in this position can be secured by locating the flights over the bracket and securing one side wall to the back side of the bracket. In this orientation, very little veiling effect is generated.

Consequently, from the foregoing description, it will be seen that identical flights may be used throughout the drying zone of the rotary drum mixer, with their orientation being changed in accordance with the drying needs for particular aggregates and the required exhaust temperatures. Thus, for a given aggregate run, the flights can be adjusted in one or more of these orientations to provide the desired veiling effect. For example, the first orientation with the sawtooth edges away from the wall may be used in conjunction with the fifth orientation, i.e., the flights in one axial set of flights may have a number of flights in the fifth orientation and a substantially larger number of flights in the first orientation, all in symmetrical arrangement about the axis of the drum. The flights disposed in different axially spaced sets of flights may have different orientations or a mixture of orientations in each set, depending upon the desired veiling characteristics and exhaust temperature. By a trial-and-error procedure, the appropriate orientations of the flights may be derived. This eliminates the need for a large number of different types of flights to effect different veiling patterns for providing different exhaust temperatures.

In a preferred embodiment according to the present invention, there is provided a rotary dryer for drying aggregate comprising a generally cylindrical drum rotatable about its cylindrical axis, a plurality of flights spaced one from the other about the interior surface of the drum, each flight comprising a generally U-shaped body having a base and side walls extending from the base along opposite sides thereof, means for releasably securing the flights to the drum with the flights projecting interiorly of the drum surface in a selected one of a plurality of orientations of the flights relative to the drum surface, the side walls of the flights having first and second edges distal from the base configured differently than one another to provide respective first and second veiling patterns of the aggregate within the drum different from one another in response to rotation of the drum about the axis when the flights lie in first and second orientations, respectively, of the plurality of orientations relative to the drum surfaces, the securing means including a plurality of brackets secured to the drum at spaced intervals circumferentially about the drum surface and fasteners cooperable with the brackets for releasably securing the flights in the first orientation of the flights relative to the drum surface to enable the aggregate to fall from the first edges upon rotation of the drum to provide the first veiling pattern in the drum and in a second orientation of the flights relative to the drum wall to enable the aggregate to fall from the second edge upon rotation of the drum to provide the second veiling pattern in the drum different from the first veiling pattern.

In a further preferred embodiment according to the present invention, there is provided in a rotatable drying drum for drying aggregate material having a stream of hot gases of combustion flowing in and toward one end of the drum and a plurality of flights for generating a veil of aggregate material through the flowing hot gas stream in response to rotation of the drum, a method of adjusting the veil of aggregate through the hot gas stream, comprising providing a first set of a plurality of identical flights in a first orientation about the drum wall, providing a second set of a plurality of flights identical to the first set of flights about the drum wall and in a second orientation different from the orientation of the first set of flights, the first and second sets of flights providing in combination a predetermined veiling pattern and changing the orientation of at least one of the flights of the first set of flights relative to the drum wall to effect a veiling pattern different than the predetermined veiling pattern.

Accordingly, it is a primary object of the present invention to provide a novel and improved rotary drum dryer having identical flights releasably secured to the drum wall in one or more orientations for effecting different veiling patterns and adjusting the exhaust temperature of the drying gases.

A method for operating said dryer having said flights is also described herein.

BEST MODE FOR CARRYING OUT THE INVENTION

Figure 1:
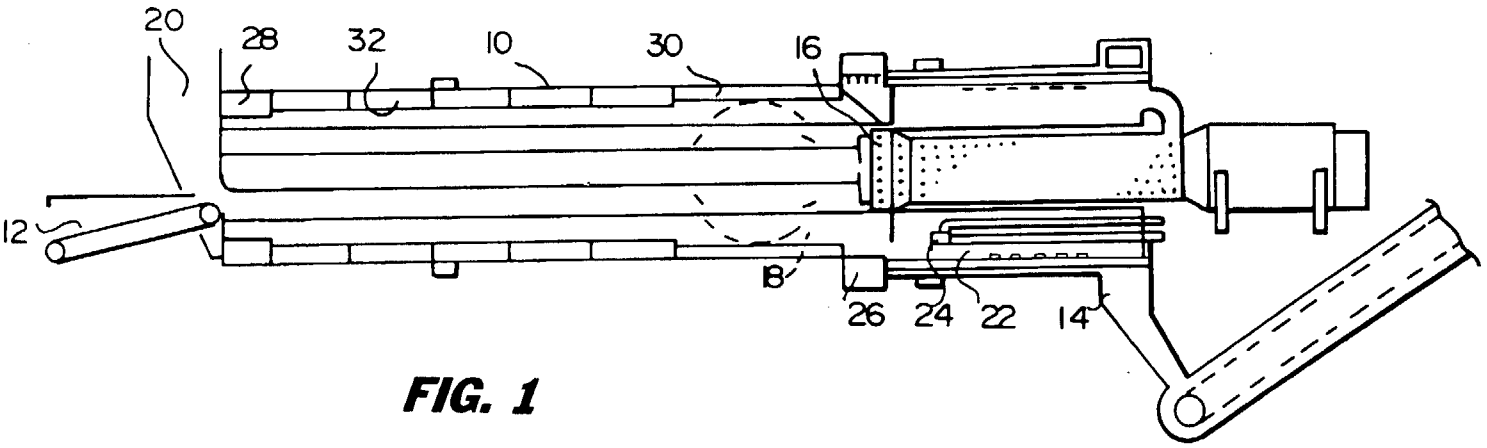
FIG. 1 is a schematic illustration of a counterflow rotary drum dryer having flights constructed in accordance with the present invention.

Referring now to FIG. 1, there is illustrated a typical rotary drum for drying aggregate, in this case a counterflow rotary drum mixer for making asphaltic material. The drum 10 is typically rotatable about an inclined axis such that particulate matter, such as aggregate, may be provided the drum through inlet 12 at its upper end, with the aggregate flowing toward the opposite end of the drum for discharge through an outlet 14. The illustrated drum 10 is a counterflow mixer having a burner head 16 exposed through the lower end of the drum for generating a flame 18 and hence hot gases of combustion for flow along drum 10 in counterflow relation to the direction of travel of the aggregate. The hot gases of combustion are exhausted from the drum through an exhaust outlet 20. In this particular form of drum for making asphaltic material, there is provided a mixing zone 22 for mixing the dried aggregate with liquid asphalt supplied through pipes 24. Alternatively, the dried virgin aggregate may be mixed with recycle aggregate supplied through an inlet collar 26 into the mixing zone 22. Of course, the virgin aggregate may also be mixed with both recycle asphalt and liquid asphalt in mixing zone 22. In this drum, spiral flights 28 are circumferentially spaced about the upper end of the drum for directing the aggregate into the drying zone. Combustion flights 30 are also circumferentially spaced one from the other about the interior of the drum wall in the region of the flame 18 for preventing the aggregate from veiling directly into the flame. Intermediate the spiral and combustion flights 28 and 30, respectively, are provided a plurality of drying flights 32. Preferably, the drying flights are provided in sets of axially spaced flights, with each set having a plurality of circumferentially spaced flights about the interior of the drum. While the foregoing is only a general description of a counterflow drum dryer/mixer, it will be appreciated that the flighting arrangements in accordance with the present invention may likewise be utilized in a parallel flow drum dryer or dryer/mixer wherein the aggregate and hot gases of combustion flow in like axial directions along the drum.

Figure 3:
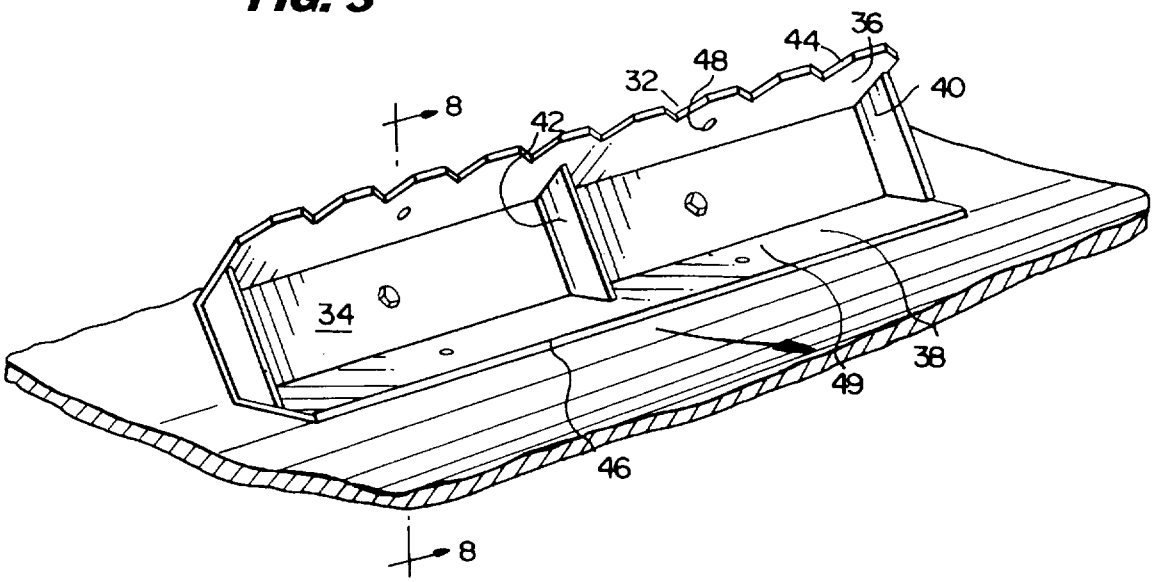
FIGS. 3 and 4 are views similar to FIG. 2, with flights secured to the brackets of FIG. 2 in first and second orientations of the flight, respectively.
Figure 8:
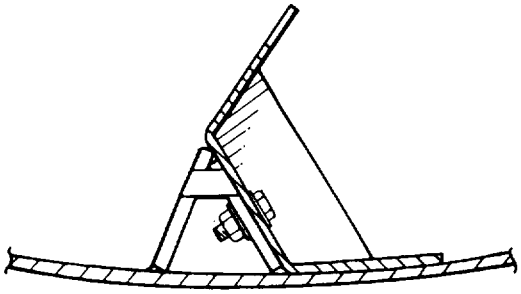
FIGS. 8, 9 and 10 are cross-sectional views taken generally about on lines 8—8, 9—9 and 10—10 in FIGS. 3, 5 and 7, respectively.
Figure 9:
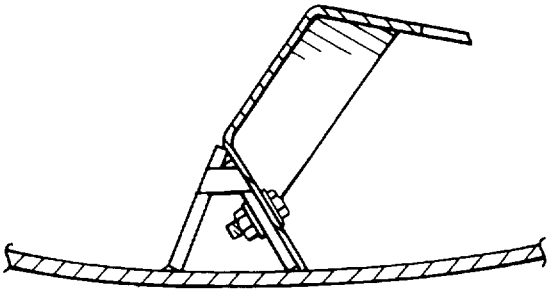

Referring now to FIGS. 3 and 8, each of the flights for the drying zone of the drum 10 is identical in construction to every other flights in the drying zone. Thus, each flight comprises a generally U-shaped flight body in cross-section, having a base 34 and a pair of side walls 36 and 38 projecting outwardly from the base and inclined away from one another, forming a trough for receiving aggregate, as explained hereafter. Opposite ends of the flights 32 are provided with end dams 40 and an intermediate dam is provided at 42 for structural purposes. Essentially, each flight comprises a bucket for scooping up aggregate along bottom portions of the drum as it rotates and elevating the aggregate such that it gradually falls or cascades from the flight as the drum rotates to form an aggregate veil across the drum cross-section. To afford a different veiling pattern using the same identical flight 32, the first side wall 36 has a generally sawtooth elongated edge 44 distal from the base 34 and the second side wall 38 has a generally straight edge 46. Thus, depending upon the orientation of the flight when secured to the wall (compare FIGS. 3 and 4), the veiling pattern will be different, as explained hereafter. Each of the side walls 36 and 38, as well as the base 34, is also provided with a pair of opening 48, 49 and 50, respectively, to facilitate securement of the flight in any one of a plurality of orientations relative to the drum wall, as described hereafter.

Figure 2:
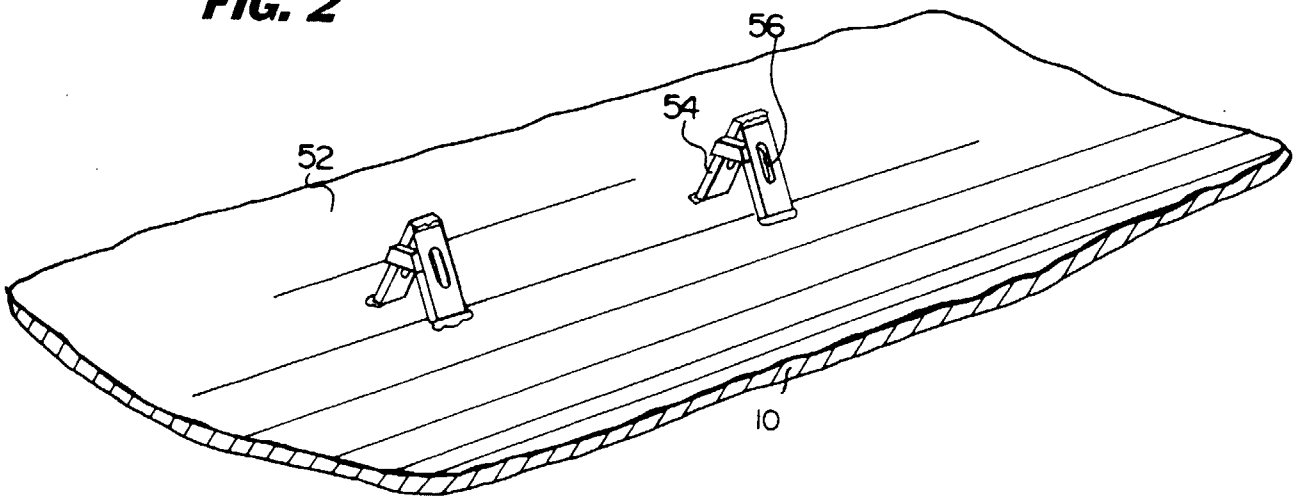
FIG. 2 is an enlarged fragmentary perspective view illustrating brackets secured to the interior drum surface for securing a flight to the drum wall.

Referring to FIG. 2, there is provided means for releasably securing the flights to the drum with the flights projecting interiorly of the drum surface in a selected one of a plurality of orientations. Preferably, such means includes a plurality of brackets 52 comprised of a pair of flanges or tabs 54 arranged in an inverted V, with the distal ends of the flanges 54 secured, for example, by welding, to the drum wall 10. Each flange 54 includes an elongated slot 56 for receiving a bolt for securing the flight to the bracket 52. Preferably, pairs of brackets 52 are spaced circumferentially one from the other about the interior wall surface of the drum and project inwardly for securing a set of flights at that axial location along the drum. It will be appreciated that other types of brackets may be used to secure the flights to the drum, such as generally U-shaped channels or individual generally L-shaped brackets. From a review of FIG. 1, it will be appreciated that the flights are provided in circumferentially spaced sets thereof axially spaced one from the other. To secure the flights to the brackets, bolts 58 with associated nuts 60 are employed, the bolts extending through the aligned openings 48, 49 or 50, and through the slots 56 of the brackets for releaseably securing the flights to the drum wall.

Figure 4:
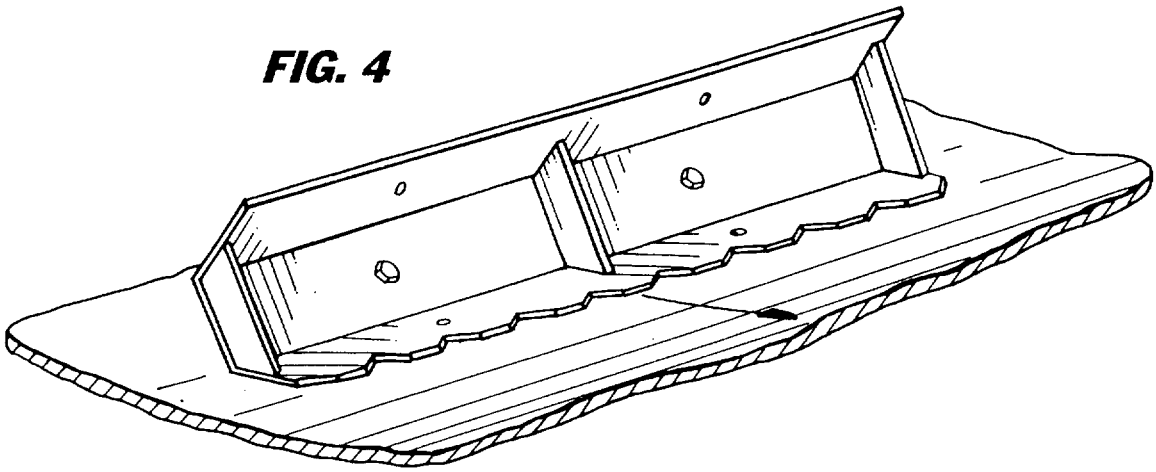

In using the flight arrangement of the present invention, the flights may be provided initially in a standard orientation such as a first orientation illustrated in FIG. 3. In that first orientation, the base 34 of each flight is secured to the brackets 52 by the bolt and nut arrangements and with the first side wall 36 with the sawtooth edge 44 thereof away from the drum wall. In this first orientation, the side wall 38 lies generally parallel and in close juxtaposition or engagement with the drum wall. Strictly speaking, the side wall 38 lies along a chord along the drum wall. By locating the sawtooth edge 44 away from the drum wall, aggregate scooped into the flight resulting from drum rotation will fall from the sawtooth edge 44 earlier during drum rotation than the aggregate would fall from the generally linearly extending edge 46 in a second orientation illustrated in FIG. 4. Thus, a substantially heavy veiling pattern would occur in the initial portions of the drum rotation and a lighter pattern in the later stages of rotation until the flight is empty. In the second orientation with the linear edge away from the drum wall, as illustrated in FIG. 4, more of the aggregate material is retained by the flight for a greater period of time during drum rotation. Therefore, the veiling pattern occurs later as the drum rotates and continues further across the drum cross-section. It will be appreciated that in both of these first and second orientations, the base 34 of each flights 32 is secured to the brackets 52.

Figure 5:
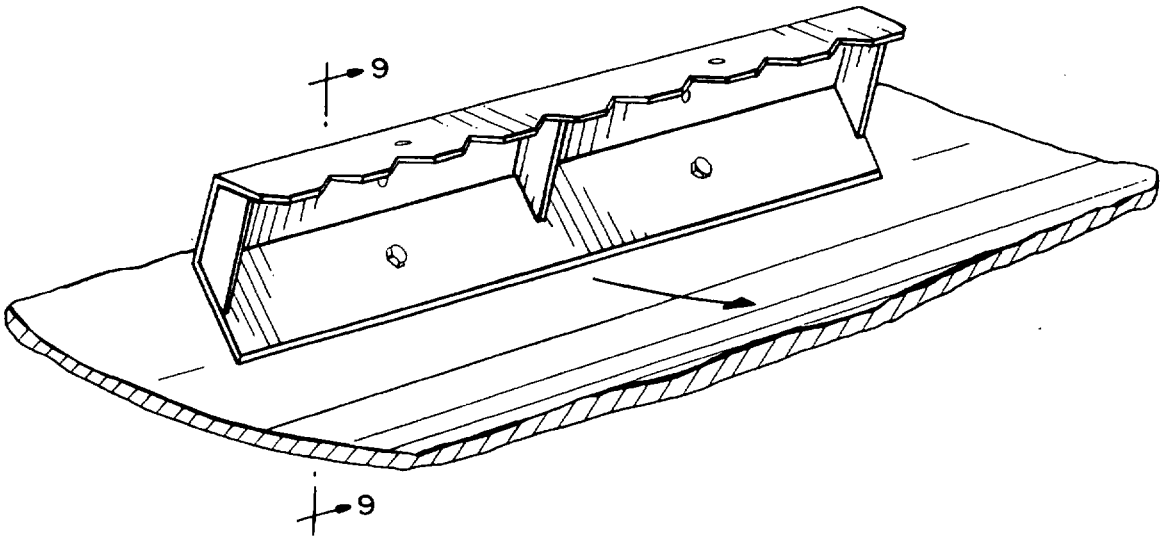
FIGS. 5 and 6 are views similar to FIGS. 3 and 4, with the flights in third and fourth orientations, respectively.
Figure 6:
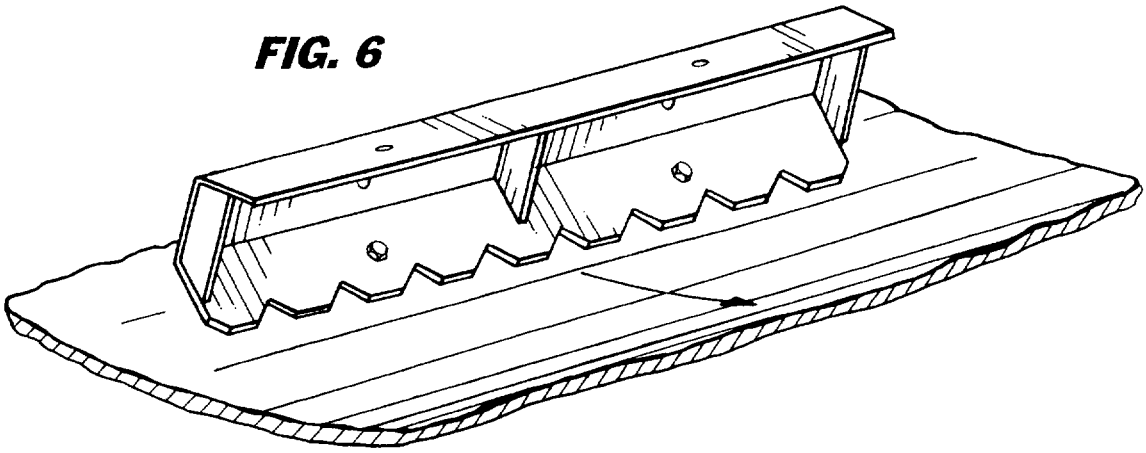

Referring to FIGS. 5 and 6, there is illustrated third and fourth orientations of flights 52 constructed identically as previously described. In FIG. 4, the flight 32 is secured to the brackets by passing the bolts through the openings 48 in side wall 38 and the openings 56 in brackets 52 with the opposite side wall 36 with its sawtooth edge spaced away from the drum wall. FIG. 6 illustrates a fourth orientation of the flight with the side wall 36 secured directly to the brackets 52 and the side wall 38 with its straight edge spaced away from the drum wall. Consequently, it will be appreciated that the angle of the flights relative to the drum wall is increased in the direction of drum rotation. Substantially more material is carried by the flights in these third and fourth orientations as compared with flights in the first and second orientations. In the third orientation of flights illustrated in FIG. 5, the veiling pattern will occur and terminate earlier in the rotational cycle than the veiling pattern provided by the flights oriented as illustrated in FIG. 6, it being understood that the orientation of the flights in FIGS. 5 and 6 cause a later veiling pattern than either one of the flights in the first and second orientations of FIGS. 3 and 4.

Figure 7:
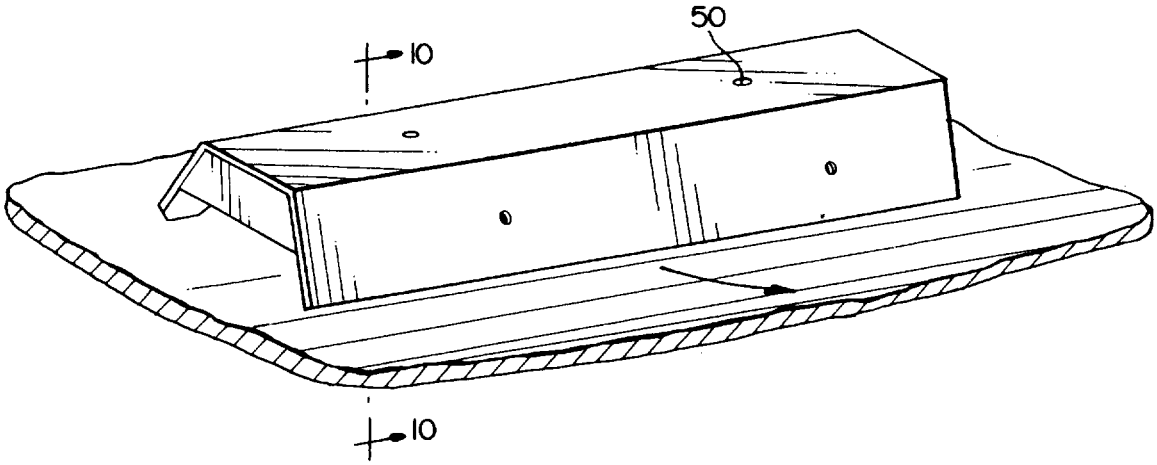
FIG. 7 is a view of a flight secured to the brackets of FIG. 2 in a fifth orientation.
Figure 10:
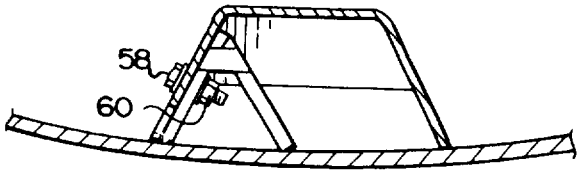

A fifth orientation of flights is illustrated in FIG. 7. Here, the generally U-shaped flight is inverted relative to the drum wall such that the first and second edges of the side walls 36 and 38 lie in close juxtaposition with or engage against the drum wall. As best illustrated in FIG. 10, the flights in this fifth orientation are secured to the brackets by the nut-and-bolt arrangement, with the brackets being disposed within the flight.

The drum hereof may be initially provided with all drying flights arranged in one orientation, for example, the second orientation. By drying an initial quantity of aggregate, the exhaust temperature from the drum via exhaust outlet 20 can be measured. If the exhaust temperature is too high or too low, the orientation of one or more of the flights is adjusted to raise or lower the exhaust temperature as desired. For example, if the exhaust temperature is initially too high, selected individual flights in one or more of the axially spaced sets of flights can be reoriented to provide an increase in veiling. To accomplish this, such selected flights can be unbolted and rebolted in another configuration, i.e., the third or fourth orientations or combinations thereof. This increase in veiling will cause a greater heat exchange between the hot gases and the moist aggregate thereby lowering the stack exhaust temperatures. To raise the exhaust temperature, selected flights of one or more of the axially spaced sets thereof may be unbolted and rebolted to the brackets in an orientation affording a lesser veiling effect, e.g., change the flights from a second, third or fourth orientation to a first, second or third orientation, respectively. In this manner, the veiling pattern across the drum is reduced, resulting in less heat transfer between the hot gases and the aggregate and, hence, higher exhaust gases. Importantly, the exhaust temperature may be adjusted using the same flights without the need to replace existing flights with new flights of different configurations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary dryer for drying aggregate comprising:

a generally cylindrical drum rotatable about its cylindrical axis;

a plurality of flights spaced one from the other about the interior surface of said drum, each flight comprising a generally U-shaped body having a base and side walls extending from said base along opposite sides thereof;

means for releasably securing said flights to said drum with said flights projecting interiorly of said drum surface in a selected one of a plurality of orientations of said flights relative to said drum surface, said side walls of said flights having first and second edges distal from said base configured differently than one another to provide respective first and second veiling patterns of the aggregate within the drum different from one another in response to rotation of the drum about said axis when said flights lie in first and second orientations, respectively, of said plurality of orientations relative to said drum surfaces;

said securing means including a plurality of brackets secured to said drum at spaced intervals circumferentially about said drum surface and fasteners cooperable with said brackets for releasably securing said flights in said first orientation of said flights relative to said drum surface to enable the aggregate to fall from said first edges upon rotation of the drum to provide said first veiling pattern in said drum and in a second orientation of said flights relative to said drum wall to enable the aggregate to fall from said second edges upon rotation of the drum to provide said second veiling pattern in said drum different from said first veiling pattern.

2. A dryer according to claim 1 wherein a first set of said plurality of flights are secured to said drum in said first orientation and a second set of said plurality of flights are secured to said drum in said second orientation, said flights of said plurality thereof being identical in configuration relative to one another.

3. A dryer according to claim 1 wherein said first edges have a generally sawtooth pattern therealong and said second edges are generally straight.

4. A dryer according to claim 1 wherein said side walls comprise first and second side walls generally planar in configuration and inclined away from one another in a direction away from said base, said flights in said first orientation having said first side walls extending generally parallel to the drum surface in an axial direction, with said second side walls radially inwardly thereof and in said second orientation, having said second side walls extending generally parallel to the drum surface in said axial direction with said first side walls radially inwardly thereof.

5. A dryer according to claim 1 wherein said side walls comprise first and second side walls generally planar in configuration and inclined away from one another in a direction away from said base, said flights in said first and second orientations opening in directions generally away from said drum surface.

6. A dryer according to claim 1 wherein said side walls comprise first and second side walls generally planar in configuration and inclined away from one another in a direction away from said base, said flights in said first and second configuration opening in directions generally toward said drum surface.

7. A dryer according to claim 1 wherein said side walls comprise first and second side walls generally planar in configuration and inclined away from one another in a direction away from said base, said securing means releasably securing said flights in a third orientation thereof relative to said drum surface with said first and second edges of each flight lying closer to said drum surface than the base thereof.

8. A dryer according to claim 1 wherein said brackets project radially inwardly of said drum surface and have angularly related surfaces against one of which said bases abuts for orienting said flight in said first and second orientations.

9. In a rotatable drying drum for drying aggregate material having a stream of hot gases of combustion flowing in and toward one end of the drum and a plurality of flights for generating a veil of aggregate material through the flowing hot gas stream in response to rotation of the drum, a method of adjusting the veil of aggregate through the hot gas stream, comprising:

providing a first set of a plurality of identical flights in a first orientation about the drum wall;

providing a second set of a plurality of flights identical to said first set of flights about the drum wall and in a second orientation different from the orientation of said first set of flights;

said first and second sets of flights providing in combination a predetermined veiling pattern, the flights of each first and second sets thereof each comprising a generally U-shaped body having a base and side walls extending from said base along opposite sides thereof; and changing the orientation of at least one of the flights of said first set of flights relative to the drum wall to effect a veiling pattern different than said predetermined veiling pattern, the step of changing the orientation including forming first and second edge patterns along first and second edges of said side walls, respectively, distal from said base and which patterns are different from one another, and releasably securing the one flight in a first orientation With a first edge of a side wall further away from the drum wall than said second edge and releasably securing the one flight in a second orientation with a second edge of another of said side walls further away from the drum wall than said first edge.

10. A method according to claim 9 wherein the step of changing the orientation includes changing the inclination of said one flight relative to the drum wall.

11. A method according to claim 9 including changing the inclination of said one flight relative to the drum wall.

* * * * *